US006869460B1

(12) United States Patent
Bennett et al.

(10) Patent No.: US 6,869,460 B1
(45) Date of Patent: Mar. 22, 2005

(54) CEMENTED CARBIDE ARTICLE HAVING BINDER GRADIENT AND PROCESS FOR PRODUCING THE SAME

(75) Inventors: Stephen L. Bennett, Antioch, TN (US); Mark J. Jagner, Ypsilanti, MI (US)

(73) Assignee: Valenite, LLC, Madison Heights, MI (US)

( * ) Notice: Subject to any disclaimer, the term of this patent is extended or adjusted under 35 U.S.C. 154(b) by 0 days.

(21) Appl. No.: 10/666,268

(22) Filed: Sep. 22, 2003

(51) Int. Cl.[7] ..... C22C 29/02
(52) U.S. Cl. ..... 75/236; 75/242; 428/547
(58) Field of Search ..... 75/236, 242; 428/547, 428/546

(56) References Cited

U.S. PATENT DOCUMENTS

| | | | | |
|---|---|---|---|---|
| 4,249,955 | A | | 2/1981 | Grab et al. |
| 4,491,559 | A | | 1/1985 | Grab et al. |
| 4,610,931 | A | | 9/1986 | Nemeth et al. |
| 4,743,515 | A | | 5/1988 | Fischer et al. |
| RE34,180 | E | | 2/1993 | Nemeth et al. |
| 5,286,549 | A | | 2/1994 | Hartzell et al. |
| 5,310,605 | A | | 5/1994 | Baldoni, II et al. |
| 5,380,408 | A | | 1/1995 | Svensson |
| 5,413,869 | A | | 5/1995 | Hartzell et al. |
| 5,418,049 | A | | 5/1995 | Drougge |
| 5,453,241 | A | | 9/1995 | Akerman et al. |
| 5,494,635 | A | | 2/1996 | Bennett |
| 5,560,839 | A | | 10/1996 | Bennett et al. |
| 5,594,931 | A | | 1/1997 | Krall et al. |
| 5,618,625 | A | | 4/1997 | Okamura |
| 5,660,881 | A | | 8/1997 | Okamura |
| 5,713,133 | A | | 2/1998 | Bhat et al. |
| 5,856,626 | A | | 1/1999 | Fischer et al. |
| 6,007,922 | A | | 12/1999 | Sue et al. |
| 6,267,867 | B1 | * | 7/2001 | Olson ..... 205/640 |
| 6,344,265 | B1 | * | 2/2002 | Blomstedt et al. ..... 428/216 |

* cited by examiner

*Primary Examiner*—Ngoclan T. Mai
(74) *Attorney, Agent, or Firm*—Burns, Doane, Swecker & Mathis, L.L.P.

(57) ABSTRACT

An eta-phase-free cemented carbide insert with improved surface hardness and wear resistance containing WC, and possibly cubic phases of a carbide and/or carbonitride, in a binder phase of Co, Ni, Fe or a combination thereof, with a binder phase gradient in the surface and near surface regions, is disclosed. The nominal binder phase content in the insert is 3–20 weight %. The surface, and near surface cobalt content is 50–100% of the binder phase content of the inner portion of the insert. The insert is formed by standard sintering practices, followed by the chemical removal of the binder phase from the surface and near surface regions of the insert. The insert is then heat treated at a temperature of 1300–1350° C. in a carburizing atmosphere, for a time of 5–400 minutes to cause diffusion of the binder phase from the interior into the binder depleted surface regions.

31 Claims, 3 Drawing Sheets

CEMENTED CARBIDE ARTICLE HAVING BINDER GRADIENT AND PROCESS FOR PRODUCING THE SAME

FIELD OF THE INVENTION

The present invention relates to a cemented carbide material which exhibits a gradient in binder concentration. In particular, the material exhibits a relatively low binder concentration near surface regions and nominal concentrations at the interior of the material. The invention also relates to methods of producing the above.

BACKGROUND OF THE INVENTION

Various constructions and techniques will be described below. However, nothing described herein should be construed as an admission of prior art. To the contrary, Applicants expressly preserve the right to demonstrate, where appropriate, that anything described herein does not qualify as prior art under the applicable statutory provisions.

Cemented Carbide inserts and articles have been commercially available for use as cutting tools, wear parts and dies for many years. Typical cemented carbides are comprised of metal carbides, normally WC, often with the addition of carbides of other metals such as Ti, Ta, Nb, V, Zr, etc., and a metallic binder comprising Co, Ni, Fe or combination thereof. Various combinations of binders and metal carbides are mixed together in a body to produce the desired characteristics of hardness, toughness, and chemical and abrasion resistance. Cemented WC parts incorporating a binder in nominal concentrations between about 2 and 30 weight %, and cubic carbides such as TiC, TaC, NbC, VC and ZrC, and combinations thereof in concentrations up to about 30% by weight of the total weight have the requisite characteristics for most applications useful to the automobile and other industries. The parts formed from such cemented carbides are often coated with one or more refractory layers to impart desired characteristics which may be lacking in the substrate material or to otherwise improve performance of the finished article. Known coatings include $Al_2O_3$, $ZrO_2$, $Y_2O_3$, AlN, cBN, as well as nitrides and carbonitrides of Groups IVA and VA, and combinations thereof.

Parts combining various amounts of metal carbides and binders, as well as different carbide phases, have been developed in attempts to optimize performance. U.S. Pat. Nos. 4,743,515 and 5,856,626 from Fischer et al. attempted to improve the strength of cobalt cemented carbide by creating a two-layered body utilizing eta-phase. Eta-phase is understood in the industry to mean compositions of tungsten, cobalt and carbon, such as $M_6C$ and $M_{12}C$, where M=tungsten and cobalt, for example $W_3CoC$. However it is known in the art that eta-phase forms brittle grains around WC crystals, providing sites for crack initiation and propagation. The presence of eta-phase results in a marked reduction in strength of the resulting article. Fischer et al. disclose parts having an inner layer comprised of WC, Co and eta-phase, with an outer layer which was eta-phase-free. In the substrates described by Fischer et al., the cobalt concentration in the eta-phase-free outer layer varies with depth from about 10–90% of the nominal value at the surface, to at least 120% of nominal, and then drops sharply in the inner eta-phase containing layer. The method for achieving the two layers requires sintering powders having substochiometric quantities of carbon at high temperature to generate eta-phase and then transforming the outer layer of eta-phase via high temperature carburization.

U.S. Pat. No. 5,453,241 by Akerman et al. seeks to improve the toughness of products produced per Fischer et al. by establishing a method of high temperature carburization followed by rapid cooling. All of the foregoing patents share the drawback of containing eta-phase, which is brittle and acts as a source for fracture initiation and propagation. Furthermore, the use of temperatures greater than 1400° C. for post sintering heat treatments has the drawback of loss of geometric features, warpage, and a reduction in hardness, due to excessive grain growth. Another drawback of this prior art is the presence of porosities in the substrate which are detrimental to the performance of the finished article.

Modifications can also be carried out by increasing the concentration of the binder phase in the near surface regions of the part. This binder phase enrichment improves certain properties of the part, such as toughness, but has the drawback of leaving residual binder at the surface, which interferes with later coating of the part. U.S. Pat. Nos. 5,560,839; 5,660,881; 5,618,625; and 5,713,133 detail the removal of the binder from the surface by etching, grinding, and other means followed by coating of the article with diamond. A drawback to these methods is increased porosity in the body and damage to the WC grains at the surface. U.S. Pat. No. 5,380,408 by Svensson details a method of removing cobalt from the surface of a part having a cobalt enriched surface region by chemical etching without removal of cobalt channels between the hard material grains. Removal of only the surface cobalt is asserted to improve coating adherence without creating undesirable porosity in the part.

Another drawback of the cobalt enriched surface region in the cemented carbide is a resulting decrease in hardness and chemical wear resistance, particularly when machining super alloys, such as titanium and its alloys. This lack of hardness leads to accelerated tool wear, even when coatings are applied to the part. Alternative materials such as eta-phase containing cemented carbides, discussed above, and selected cemented carbides consisting of WC with very small amounts of cobalt and ceramics, are thought to lack sufficient toughness to withstand forces associated with repeated use of tools, wear parts and dies. It is therefore desirable to produce a cemented carbide part having a combination of hardness and toughness, which overcomes the drawbacks of the prior art.

SUMMARY OF THE INVENTION

It has been demonstrated in the present invention that a body which is eta-phase-free, and exhibits a binder concentration which gradually increases from concentrations at or near zero in the surface regions of the article to higher concentrations, not exceeding nominal concentration levels, in the interior of the part provides a desirable combination of hardness and toughness.

According to a first aspect, the present invention provides a hard, wear resistant article of manufacture comprising a cemented carbide substrate, substantially free of eta-phase, comprising tungsten carbide and 2–30 weight % binder selected from the group consisting of Co, Ni, Fe, and combinations thereof, wherein binder concentration increases from approximately zero at the substrate surface to nominal at a selected distance interior to the surface and does not exceed nominal.

According to another aspect, the present invention provides an article of manufacture comprising an eta-phase-free cemented carbide body, composed of well defined metal carbide grains and a binder wherein said binder concentration varies within the part according to a binder concentration gradient decreasing from nominal concentrations in the interior of the part to less than 1% at the part surface.

According to a further aspect, the present invention provides a method of making a hard, wear resistant article comprising the steps of: a) heat treating a green or pre-sintered article to produce a fully sintered product; b) removing binder from surface regions of a cemented carbide article to a selected depth within said article by immersion in a chemical etching solution; c) heating the etched article in a vacuum between 1225 and 1275° C.; and d) further heating the article in a carburizing atmosphere between 1300 and 1350° C. for a time sufficient to diffuse binder from interior regions of the article into said surface regions.

According to yet another aspect, the present invention provides a method of making a hard wear resistant article comprising the steps of: a) removing binder from surface regions of a cemented carbide article to a selected depth within said article; b) heating the article in a vacuum to between 1200 and 1250° C.; and c) introducing an atmosphere comprising carbon monoxide and further heating the article to between 1300 and 1350° C. and holding at that temperature in the carbon monoxide atmosphere for a period of time sufficient to diffuse binder from interior regions of the article into said surface regions.

DETAILED DESCRIPTION OF THE INVENTION

The present invention relates to articles comprising an eta-phase-free cemented carbide part having well defined metal carbide grains and a binder concentration between 0 and 1 weight %, preferably 0 weight %, at the surface of the part. In the inner regions of the part, binder concentration is equal to the nominal concentration for the selected cemented carbide grade. Therebetween, a concentration gradient is present wherein the concentration of the binder decreases from nominal in the interior of the part to at or near zero at the substrate surface. Concentration of the binder in the near surface region is controlled to form this gradient of decreasing binder concentration moving from the interior of the part to the outer surface of the substrate. The decreasing binder concentration of the present invention extends over a selected distance, which is controlled by processing parameters, for example duration of each step, concentration of the etching solutions, temperature, and the nominal binder concentration. Control of these parameters and their affects can be readily ascertained based from the methods described herein by one of ordinary skill in the art. Selected distances over which the gradient extends range from approximately 25–500 microns, preferably 100–250 microns.

Binders may be selected from any of Co, Ni, Fe or combinations thereof, wherein Co comprises a minimum weight percent of 50% of the binder. In a preferred embodiment, the binder is cobalt, with inevitable impurities. Nominal binder concentration may be selected to achieve various properties in the part, but generally ranges from 3–20 weight %, preferably 5–12 weight %. Cemented WC parts of the invention may incorporate cubic carbides such as TiC, TaC, NbC, VC, HfC, $Cr_2C_3$ and ZrC, and combinations thereof in concentrations up to about 30 weight % of the total weight.

Figure 1:
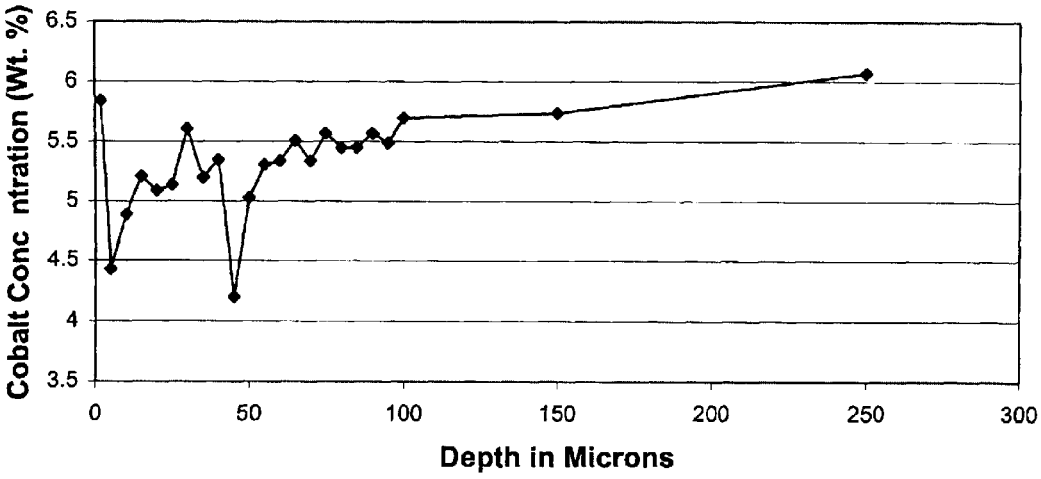
FIG. 1 is a plot of the cobalt concentration versus the depth beneath the surface for a 6 weight % Co part according to one embodiment of the present invention.
Figure 2:
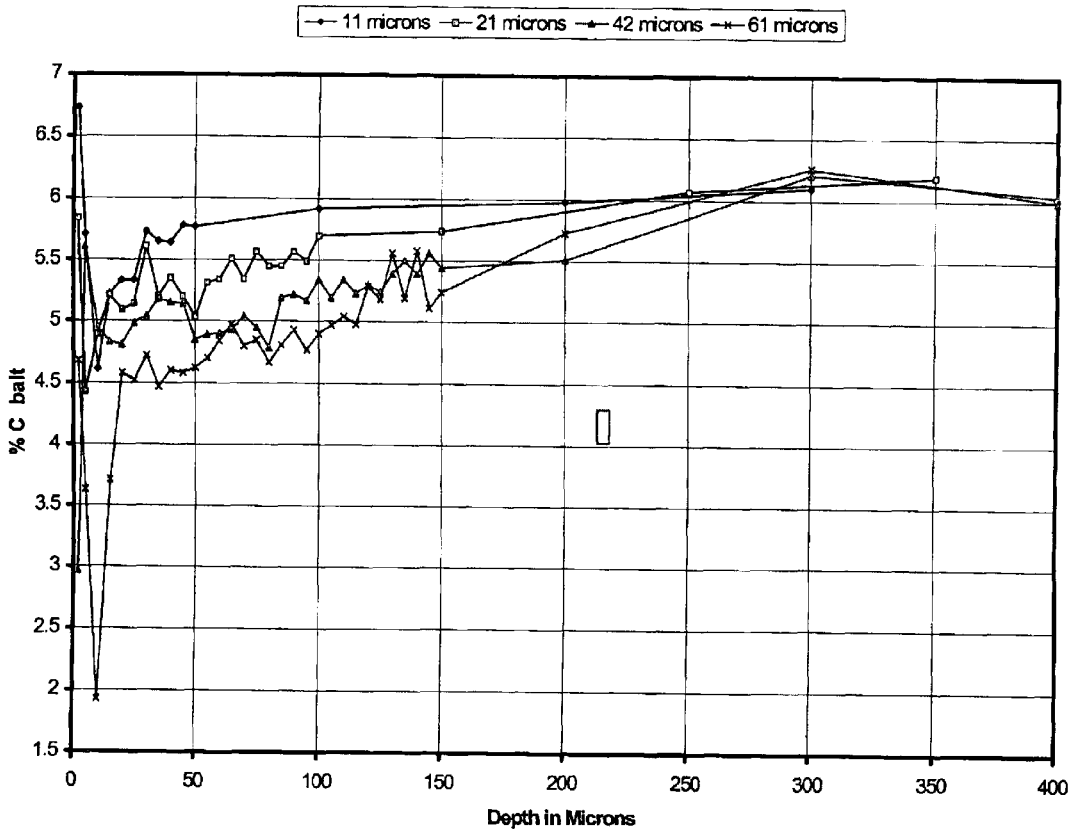
FIG. 2 is a plot of cobalt concentration versus depth beneath the surface for different embodiments of the present invention based on different depths of etch and an identical heat treatment.

In a first embodiment of the invention, the substrate is a cobalt cemented tungsten carbide material having a nominal binder concentration of 6 weight %. The binder concentration in the interior of the part is nominal and decreases to less than nominal along a gradient to the near surface regions of the part, preferably the near surface regions are from 5–10 microns beneath the surface. The concentration gradient begins at approximately 100–250 microns below the surface, with the binder concentration gradually decreasing until it reaches a minimum at the near surface region, as illustrated in FIGS. 1 and 2.

Figure 3:
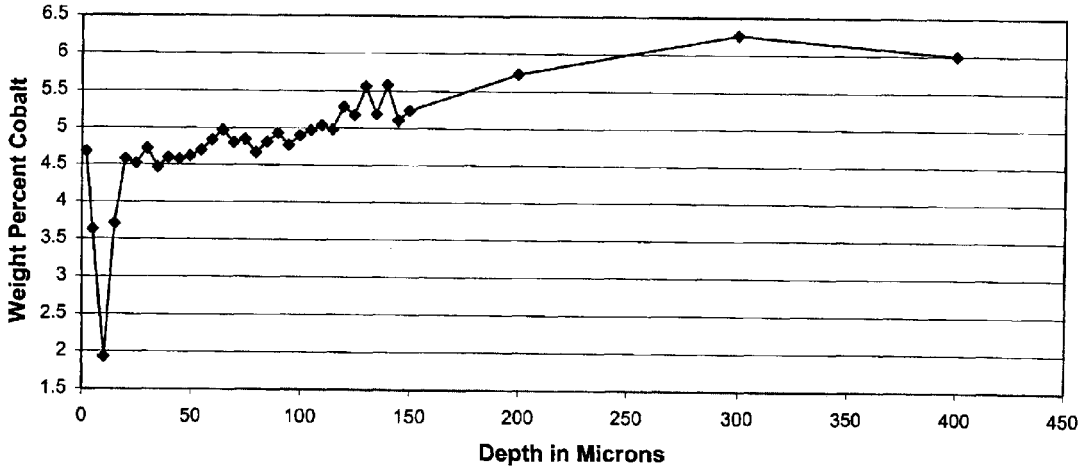
FIG. 3 is a plot depicting the depth at which the cobalt concentration returns to nominal after heat treatment of an embodiment of the present invention.

In a second preferred embodiment, having a nominal binder concentration of 6 weight %, the gradient begins at 400 microns below the surface and reaches a minimum at the near surface region, as illustrated in FIG. 3.

The surface has a porosity of less than 1 volume %. Preferably maximum porosity is less than 0.5 volume %, most preferably ranging from 0.4 to 0.1 volume %. In the most preferred embodiment, the porosity is less than 0.2 volume %. The part also exhibits substantially no distortion, which would contribute to malformation or warpage of the finished article.

The present method of producing articles with an eta-phase-free, binder gradient includes removing binder from the sintered part surface and near surface regions over a selected distance into the interior of the part and subsequent heat treating to cause migration of binder from the interior of the article into the binder depleted region. The result of this process is a controlled change in concentration of binder without spikes in concentration of binder to greater than nominal in the substrate. While greater than nominal concentrations of binder are considered beneficial in prior art, it is believed that low concentration gradually increasing to nominal, without regions of high binder concentration, provide a more cohesive substrate and better predictability in performance of the article of the present invention.

Optionally, the articles may also be ground, subjected to a carbon correction or other processing provided that such processing does not interfere with the effectiveness of the described binder removal and heat-treating process.

Binder removal according to the present invention is generally accomplished through chemical etching. See, for example, U.S. Pat. No. 5,560,839 which details a variety of chemical systems for etching cobalt binder, the content of which is incorporated here by reference in its entirety. While any of the afore-referenced chemical systems may be used to etch the binder phase, the preferred embodiment makes use of a ferric chloride solution to chemically etch the binder from the substrate to a selected depth. Those skilled in the art will recognize that the depth of etching of the binder will depend upon the molality of the ferric chloride solution, the temperature, the reaction time, and the composition of the part (i.e. nominal cobalt content, binder chemistry and carbide grain size) so that some reaction experimentation is expected prior to industrial application to define optimum process parameters. Preferred concentrations of ferric chloride aqueous solutions for use in the present invention range from 0.005 M to 1.0 M, but other concentrations known in the art may be used. An approximately 20 micron depth of etch may be achieved by immersing the selected article in 0.005 M ferric chloride for a period of approximately 2 hours; doubling the immersion time yields an approximately 37 micron depth of etch.

Those skilled in the art will recognize that the preferred depth of binder removal is dependant upon the end use to which the cemented carbide part will be put, and the ranges given herein are not to be construed as limiting, but rather as merely illustrative of use for a cutting tool insert. Alternately, binder may be removed via other methods known in the art that are not incompatible with the remainder of the process.

The apparatus used in the heat-treating process of the present invention comprises an enclosed vessel and a retort of steel or other suitable material. The reaction vessel is provided with an inlet and an outlet whereby the gaseous atmosphere for heat-treating enters the vessel through the inlet, flow through a reaction zone containing the part and exits through an outlet. Typically the vessel includes a premix area such as a chamber, where the gases utilized are premixed at a temperature lower than the heat-treating temperature. This premix area can be internal or external to the vessel or the reaction zone. In one embodiment uniformly mixed gases exiting the premix chamber flow into the inlet and continue into the reaction zone. The apparatus is equipped with furnace controls for process parameter regulation, such as monitoring and adjusting processing time, the vessel's temperature and pressure, the temperature and pressure of the premix area, flow rate and partial pressures of gasses at selected points within the apparatus. Preferably, as is typical of manufacturing level furnaces, the furnace controls can be set at selected process parameters utilizing a personal computer or other computer interface with the operator. To maintain repeatability from batch to batch, in the most preferred embodiment, the process parameters are computer controlled.

The articles, cutting tools or inserts to be heated are positioned in the reaction zone by conventional means, such as tables, trays or other fixtures known in the art. The reaction vessel includes heating elements typically in the form of graphite. The reaction vessel is loaded with articles, cutting tools or inserts and may be flushed with a suitable inert gas such as nitrogen, argon, or the like. Typically, the vessel is vacuum evacuated and the temperature ramped up to within the range of 900–1300° C. and the carburizing gas is introduced. The temperature may be increased to not more than 1350° C., preferably 1300–1330° C., or maintained and the inserts held at this temperature for a sufficient time to cause diffusion of binder from the interior of the article into the etched portion, without causing deleterious warpage of the article or migration of the binder onto the surface of the article. In a preferred embodiment of the invention, carbon monoxide comprises the atmosphere in the reaction vessel during the heating step. The pressure during the heating step can be atmospheric pressure or less. Suitable pressures are within the knowledge of one of ordinary skill in the art based upon the composition and size of the carbide article and can be readily determined.

The present invention will become even clearer upon consideration of the following examples, which are intended to be illustrative of the present invention, and not limiting.

EXAMPLE 1

Step 1: Groups of sintered cemented carbide inserts containing <0.5 weight % cubic carbides and 6 weight % cobalt, were treated with freshly prepared 0.05 M ferric chloride solutions for periods of 2 and 4 hours respectively. Upon examination, the cobalt binder in the inserts was found to have been etched away to depths of 20±1 microns and 37±2 microns respectively. A second set of cemented carbide inserts containing <1 weight % cubic carbides and 12.3 weight % cobalt was top and bottom ground and then etched to depths of 21±1 micron and 34±2 microns using freshly prepared 0.05 M ferric chloride solutions for periods of 4.5 and 9 hours respectively.

Step 2: Inserts selected from each group prepared in Step 1 were heated in a furnace to approximately 1100° C. for 100 minutes in a vacuum. A second batch of the selected inserts was heated in a furnace to approximately 1250° C. for 100 minutes in a vacuum. The heat-treated inserts were then cross-sectioned, polished and examined at a magnification of 1000× on an optical microscope. No differences between the etched and the etched/heat treated inserts were observed.

EXAMPLE 2

Inserts prepared according to Example 1, Step 1, were heated in a furnace to approximately 1300° C. for 100 minutes in a vacuum. The heat-treated inserts were examined as in Example 1, step 2. Partial filling of voids in the substrate and some reduction in the cobalt content just below the etched region was observed.

EXAMPLE 3

Inserts prepared according to Example 1, Step 1, were heated in a furnace to approximately 1350° C. for 100 minutes in 1 torr argon. The resulting inserts had cobalt on the periphery and the edges were distorted.

EXAMPLE 4

Step 1: Group A sintered cemented carbide inserts containing <0.5 weight % cubic carbides and 6 weight % cobalt were etched to depths of 20±1 microns using freshly prepared 0.05 M ferric chloride solutions for 2 hours, and Group B sintered cemented carbide inserts containing <1 weight % cubic carbide and 12.3 weight % cobalt, were etched to depths of 21±1 microns using freshly prepared 0.05 M ferric chloride solutions for 4.5 hours.

Step 2: Group A and B were heat treated in 10 torr carbon monoxide. The gas was introduced at 1250° C., the temperature was ramped up to 1325° C. and held for 100 minutes. The resulting inserts were uniformly light gray in color. Losses in mass ranged from 0.01% to 0.02% and decreases in magnetic saturation levels (Ms) ranged from 0.28% to 0.37%. Surfaces of the inserts were examined optically at 1000×; well-defined WC grains were visualized and a lack of surface Co or distortion was noted. The heat-treated inserts were also examined as in Example 1, Step 2.

Cemented carbide articles which have been made according to the present invention may also be subjected to coating with monolayer or multilayer coatings.

It is intended that the specification and examples be considered as exemplary only. Other embodiments of the invention, within the scope and spirit of the aforementioned claims will be apparent to those of skill in the art from practice of the invention disclosed herein and consideration of this specification. All documents referred to herein are hereby incorporated by reference, in their entirety.

While the present invention has been described by reference to the above-mentioned embodiments, certain modifications and variations will be evident to those of ordinary skill in the art. Therefore, the present invention is limited only by the scope and spirit of the appended claims.

We claim:

1. A hard, wear resistant article of manufacture comprising a cemented carbide substrate, substantially free of eta-phase, comprising tungsten carbide and 2–30 weight % binder selected from the group consisting of Co, Ni, Fe, and combinations thereof, wherein binder concentration increases from approximately zero at a surface of the substrate to nominal at a selected distance interior to the surface and does not exceed nominal, wherein the selected distance interior to the surface ranges from 25 to 500 microns.

2. The article of manufacture of claim 1 wherein said cemented carbide body further comprises at least one carbide of a metal of Groups IVA, VA, or VIA.

3. The article of manufacture of claim 1 wherein said binder is at least 3 weight % cobalt.

4. The article of manufacture of claim 1 wherein said article has porosity of less than 0.5 volume %.

5. The article of manufacture of claim 1 wherein binder concentration increases according to a gradient of substantially constant slope extending from the surface to the interior of the substrate.

6. The article of manufacture of claim 1 wherein the selected distance interior to the surface ranges from 100 to 250 microns.

7. The article of manufacture of claim 1 wherein the nominal binder concentration is 3 to 20 wt. %.

8. The article of manufacture of claim 7 wherein the nominal binder concentration is 5 to 12 wt. %.

9. The article of manufacture of claim 1 wherein the binder consists essentially of Co, the nominal binder concentration is 6 wt. %, and the selected distance interior of a surface of the article ranges from 100 to 250 microns.

10. The article of manufacture of claim 9 wherein the binder concentration is a minimum at 5 to 10 microns below the surface of the substrate.

11. The article of manufacture of claim 1 wherein the binder consists essentially of Co, the nominal binder concentration is 6 wt. %, and the selected distance interior of a surface of the article is 400 microns.

12. The article of manufacture of claim 11 wherein the binder concentration is a minimum at 5 to 10 microns below the surface of the substrate.

13. The article of manufacture of claim 1 wherein the binder concentration is a minimum in a near surface region of substrate.

14. The article of manufacture of claim 13 wherein the near surface region is at 5 to 10 microns below the surface of the substrate.

15. The article of manufacture of claim 1 wherein the binder comprises at least 50 wt. % Co.

16. An article of manufacture comprising an eta-phase-free cemented carbide body, composed of well-defined metal carbide grains and a binder wherein a binder concentration varies within the article according to a binder concentration gradient decreasing from nominal concentrations at a selected distance interior of a surface of the article to less than 1 wt. % at the surface of the article, wherein the selected distance interior to the surface ranges from 25 to 500 microns.

17. The article of manufacture of claim 16 wherein binder concentration decreases according to a gradient of substantially constant slope.

18. The article of manufacture of claim 16 wherein the metal carbide grains comprise tungsten carbide.

19. The article of manufacture of claim 16 wherein the metal carbide grains consist essentially of tungsten carbide.

20. The article of manufacture of claim 16 wherein the binder comprises one or more of Co, Ni, Fe, and combinations thereof.

21. The article of manufacture of claim 20 wherein the binder comprises at least 50 wt. % Co.

22. The article of manufacture of claim 16 wherein the binder consists essentially of Co.

23. The article of manufacture of claim 16 wherein the binder concentration is a minimum in a near surface region of article.

24. The article of manufacture of claim 23 wherein the near surface region is at 5 to 10 microns below the surface of the article.

25. The article of manufacture of claim 16 wherein the selected distance interior to the surface ranges from 100 to 250 microns.

26. The article of manufacture of claim 16 wherein the nominal binder concentration is 3 to 20 wt. %.

27. The article of manufacture of claim 26 wherein the nominal binder concentration is 5 to 12 wt. %.

28. The article of manufacture of claim 16 the binder consists essentially of Co, the nominal binder concentration is 6 wt. %, and the selected distance interior of the surface of the article ranges from 100 to 400 microns.

29. The article of manufacture of claim 28 wherein the binder concentration is a minimum at 5 to 10 microns below the surface of the article.

30. The article of manufacture of claim 28 wherein the selected distance interior of the surface of the article ranges from 100 to 250 microns.

31. The article of manufacture of claim 16 wherein said article has porosity of less the 0.5 volume %.

* * * * *